US006845720B2

(12) United States Patent
Summa

(10) Patent No.: US 6,845,720 B2
(45) Date of Patent: Jan. 25, 2005

(54) CONVEYOR SHOCK ABSORBER

(76) Inventor: Gareth D. Summa, R.R. 1, Box 11, Denver, MO (US) 64441

( * ) Notice: Subject to any disclaimer, the term of this patent is extended or adjusted under 35 U.S.C. 154(b) by 0 days.

(21) Appl. No.: 10/410,475

(22) Filed: Apr. 9, 2003

(65) Prior Publication Data

US 2004/0200795 A1 Oct. 14, 2004

(51) Int. Cl.[7] ..... B61B 12/00

(52) U.S. Cl. ..... 104/172.3; 213/32 R; 213/32 A; 213/37; 213/38

(58) Field of Search ..... 104/172.1, 172.2, 104/172.4, 172.3; 188/75, 343, 129; 213/32 R, 32 A, 36, 37, 38, 39; 267/196

(56) References Cited

U.S. PATENT DOCUMENTS 2,615,535 A * 10/1952 Snyder ..... 188/129
2,646,860 A * 7/1953 Pirard ..... 188/129
3,870,128 A * 3/1975 Nicolay et al. ..... 188/112 R
5,027,715 A 7/1991 Moore et al.
5,067,414 A 11/1991 Moore et al.
5,632,206 A * 5/1997 Summa et al. ..... 104/172.3
6,244,451 B1 6/2001 Summa et al.
6,330,952 B2 12/2001 Summa et al.
6,330,953 B2 12/2001 Summa et al.

* cited by examiner

*Primary Examiner*—Mark T. Le
(74) *Attorney, Agent, or Firm*—John C. McMahon

(57) ABSTRACT

A shock absorbing tow bar for connecting between a drive trolley and a load carrying trolley of a conveyor system. The tow bar includes a pair of tubes that reciprocate relative to each other. A plunger is located within a first of the tubes and attached to a second tube. Mounted on the plunger are a pair of brake surfaces that frictionally engage the first tube. The brake surfaces are biased toward the first tube by springs and the force applied to the brake surfaces is adjustable through an adjustment mechanism including a pair of wedges upon which the springs are located. An adjustment rod is joined with the adjustment mechanism and extends outwardly from the tow bar to allow an operator to adjust the friction produced by the brake surfaces without disassembly of the tow bar.

9 Claims, 3 Drawing Sheets

130
115
137
98
136
115
102
102
109
122
135
121
126
115
160
142
134
128
147
118
160
123
144
120
125
153
153
145
144
151
154
141
147
150
145
160
95
126
135
124
121
154
160
122
125
123
108
105
103
93
102
137
115
115
131
102
136
99
134
128
119
53

53
112
6.
103
118
101
6.
94
100
93
194
95

118
160
53
130
153
131
93
144
128
142
145
129
95
112
151
98
154
160
99
119

CONVEYOR SHOCK ABSORBER

BACKGROUND OF THE INVENTION

The present invention is directed to a shock absorber for dampening the initial effect of relatively quick stopping and starting of a heavily loaded trolley or trolleys on a conveyor system, especially a power and free conveyor system.

Much of the assembly work done at various manufacturing plants and much of partially assembled or fully assembled transport of goods around a plant is by conveyor systems. In particular, partially completed goods or finished goods are placed on carriers with wheeled trolleys and conveyed about a plant on one type of conveyor system or another, especially the types of conveyor systems known as power and free conveyor systems. When the trolleys carrying a load come to a location where work is to be accomplished, or where the goods are simply to be accumulated, or where a moving trolley must stop because of a previously stopped trolley in front of it, etc., the trolleys and the loads on the trolleys must decelerate at a very high rate. Likewise, the drive units for such conveyors typically operate at a constant speed and loaded trolleys must almost instantly move at the speed of the driver, thereby placing stress on the conveyor parts and the goods being conveyed.

Because conveyor systems of the type described herein are utilized to transport many large and heavy items, such as washing machines, dishwashers, refrigerators, automobiles and trucks, sometimes weighing as much as 10,000 pounds each, almost instantaneous stopping and starting of the trolleys can cause damage to the loads as they try to continue in motion when stopping, or accelerate when starting. Over time this causes substantial damage to the conveyor system itself. Conveyor systems that utilize no dampening within the system very rapidly deteriorate, especially as the weight of the loads carried by the trolleys increases. Consequently, it has been recognized for some time by the conveyor industry that it is desirable to dampen the effect of the very rapid stops and starts required by many systems. This is normally accomplished by providing a lead or drive trolley which is in turn selectively driven by a driving mechanism such as a dog attached to a continuously moving chain. The drive trolley in turn is connected by a tow bar to one or more load carrying trolleys which actually support the goods being conveyed. The tow bar includes some type of dampening mechanism for reducing the stress applied to the load carrying trolleys and the load carried thereby during a quick stop or start.

The inventor of the present application has been the inventor or co-inventor of a number of different patents directed to shock absorbing devices of the type described herein, such as U.S. Pat. No. 3,330,953. Applicant has found that there is an ever increasing desire to provide a simple shock absorbing mechanism that is highly effective in dampening the effect of sudden stops and starts on the conveyor trolleys.

It has also been found that it is necessary to be able to adjust the strength of the dampening mechanism in correspondence to the weight of the load being carried by the trolleys. Where the dampening mechanism is the result of some type of resistance or friction producing mechanism, a very high resistence will result in effectively no dampening when used with very light loads, because the dampening system will never operate, whereas a light dampening resistence will have virtually no effect on dampening relatively heavy loads, because the weight of the load will overcome the resistance so easily that there will be no effective resistance, and consequently, no effective dampening. Therefore, it is also desirable to have a dampening mechanism in which the resistance can be relatively easily changed to adjust for the particular loads being carried by the trolleys. While certain prior art dampening systems for this type of device have allowed for adjustment, such adjustment has required disassembly of the dampening mechanism to such an extent that it has not been relatively easy to accomplish the change without essentially taking everything apart. Consequently, it is also desirable to have a dampening mechanism wherein adjustments can be made relatively easily when the conveyor is first placed in use, when loads on the system change, and after such a period of time when wear and tear reduces or increases resistance.

SUMMARY OF THE INVENTION

The present invention is directed to a shock absorbing tow bar for use in a conveyor system, so as to reduce the shock of stopping and starting load carriers, especially with very heavy loads. Without the shock absorbing tow bar, the required sudden stopping and starting can damage both the conveyor system and the loads being carried by the conveyor.

The tow bar has a pair of tubes reciprocally mounted with respect to each other along a common axis and with stops so as to limit maximum telescoping between the tubes. A plunger is attached to a first of the tubes by a shaft and the plunger is slidingly received in a second of the tubes. The plunger includes a pair of brake surfaces or shoes that are biased radially outward by springs so as to frictionally engage the second tube.

The pressure applied to the brake shoes can be varied in accordance with the load to apply the proper friction, so as to ensure proper operation of the shock absorber to dampen sudden stops and starts. The springs are mounted on spaced wedges for which spacing can be operably varied along an axis of the device which in turn varies the pressure applied to the springs and, consequently, the brake shoes.

An adjustment rod is threadably joined to the wedges such that rotation of the adjustment rod varies the spacing of the wedges and subsequently the pressure or force applied to the brake shoes through the springs. In this manner, the friction between the brake shoes and the second tube can be changed, so as to make relative movement between the tubes, along the axis easier or harder in accordance with the weight of the load.

The rod has a distal end that extends outward or externally relative to the remainder of the tow bar so as to allow an operator to be able to adjust the friction applied by the break shoes without disassembly of the tow bar.

OBJECTS AND ADVANTAGES OF THE INVENTION

Therefore, the objects of the present invention are: to provide a shock absorbing tow bar for use in conjunction with a conveyor system wherein the shock absorbing efficacy of the tow bar can be maintained even when the weight of the load changes by varying the resistance of the shock absorber in accordance with the weight of the load being carried; to provide such a tow bar having an adjustment mechanism that projects outwardly of a remainder of the tow bar to allow adjustment without disassembly of the tow bar; to provide such a tow bar that includes a pair of tubes with a plunger attached to a first tube and being slideable in a second tube and wherein the plunger has a pair of oppositely biased brake shoes extending radially outward from said plunger and frictionally engaging said second tube; to provide such a tow bar wherein the brake shoes are mounted on springs which in turn are mounted on wedges that can be operably varied in spacing so as to adjust the pressure applied to the shoes; to provide such a tow bar wherein the springs are captured in radially extending channels to prevent movement thereof along an axis of the tow bar; to provide such a tow bar wherein an adjustment rod threadedly engages the wedges so as to allow axial change in the spacing therebetween and thereby vary the force or pressure exerted by the brake shoes and wherein the rod extends axially outward of the tow bar so as to allow external adjustment of the force applied by the springs to the brake shoes and thereby adjustment of friction provided by the brake shoes; and to provide such a tow bar that functions extremely well in conjunction with a conveyor system, is easy to manufacture, is comparatively inexpensive to produce in view of the benefits provided and is especially well suited for the intended purpose thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
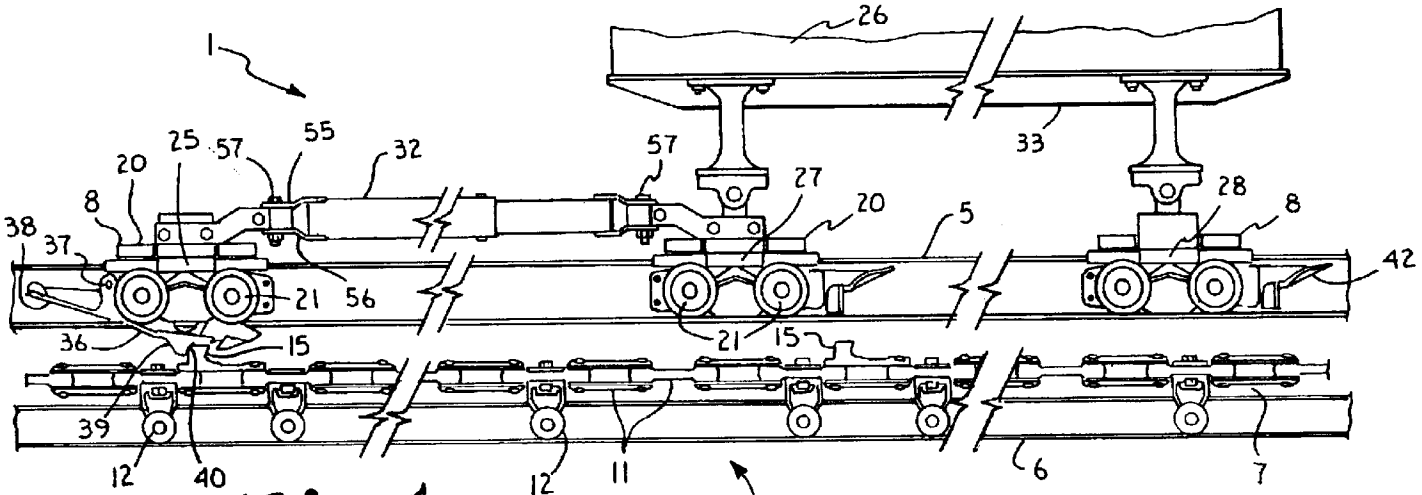
FIG. 1 is a fragmentary side elevational view of a power and free conveyor system including a lead trolley engaged by a drive chain and a pair of trailing trolleys supporting a load joined to the drive trolley by a tow bar incorporating a dampening device in accordance with the present invention.
Figure 3:
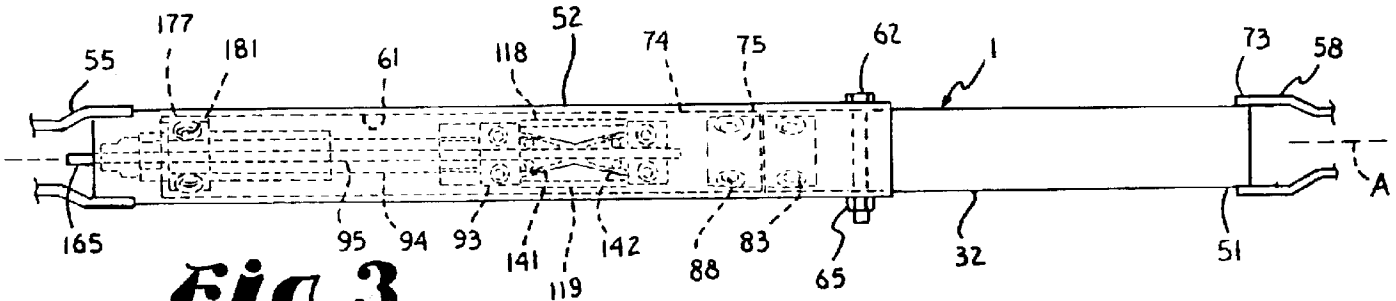
FIG. 3 is an enlarged and side elevational view of the tow bar showing various components of the dampening device therein and illustrating internal parts thereof in phantom.
Figure 2:
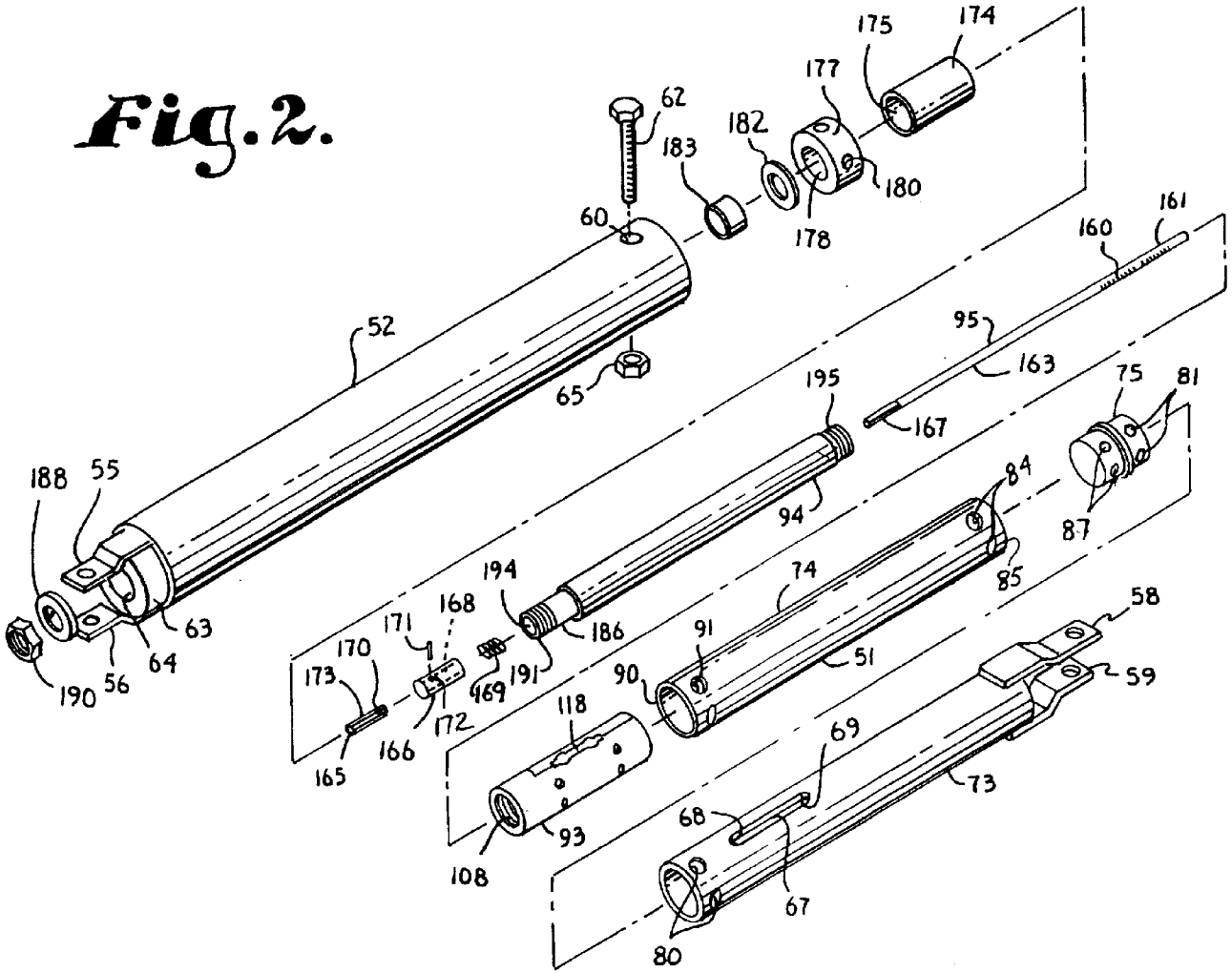
FIG. 2 is an exploded view of the tow bar and dampening device.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

FIGS. 1 through 6 illustrate a dampening mechanism or device generally indicated by the reference number 1 incorporated in a conveyor system 2 in accordance with the present invention.

The conveyor system 2 of the illustrated embodiment is a type of conveyor that is generally referred to as power and free conveyor system. The conveyor system 2 includes a first track 5, a second track 6, a continuously driven chain 7 that follows the first track 5, and trolleys 8 that follow the second track 6.

As is best illustrated in FIG. 1, the chain 7 of the conveyor system 2 includes a continuous series of links 11 which are driven in a well known manner so as to continuously move about the first track 5 of the conveyor system 2. The chain 7 is supported by a plurality of rollers 12 that are secured to the chain 7 and positioned there along so as to support the chain 7. The rollers 12 roll on and follow the first track 5. Extending upwardly from the chain 7 are a plurality of drive or chain dogs 15.

The second track 6 generally parallels the first track 5 in the region where it is desirable for the chain 7 to drive the trolleys 8. The trolleys 8 each include a body 20 and a plurality of trolley wheels 21 that are sized and shaped to roll along and follow the second track 6. The trolleys 8 of the present embodiment include a lead or drive trolley 25 and a pair of load 26 supporting trolleys 27 and 28.

The lead trolley 25 is connected to a first of the load supporting trolleys 27 by a tow bar 32. The first load supporting trolley 27 is in turn connected to the second load supporting trolley 28 by a carrier 33. It is foreseen with respect to certain installations that only single load supporting trolley or that a large number of load supporting trolleys might be necessary for particular loads.

The lead trolley 25 includes a dog engagement portion 36 that is pivotally joined to the lead trolley body 20 by a pivot 37. The dog engagement portion 36 also has a forwardly projecting lever portion 38 and a lower projecting dog engaging arm 39 that includes a tooth 40 which during normal operation of the conveyor system 2 will engage the chain dog 15, as shown in FIG. 1, in the region of the conveyor system 2 where it is desirable for the trolleys to be driven about the first track 5. The lever portion 38 is located in a position so as to engage trailing cams 42 on load supporting trolleys or load stopping disengagement cams within the track system (not shown) that are well known in the art and designed to swing the dog engagement portion 36 in such a way so as to disengage from the chain dog 15 and thereby stop providing driving power to the drive trolley 25.

The tow bar 32 includes a first inner member or tube 51, a second outer member or tube 52 and a dampening or braking assembly 53. The inner tube 51 is slideably received in the outer tube 52 and is able to reciprocate along a central axis A thereof within the limits described below and as braked by the braking assembly 53, also as described below.

The outer tube 52 has a pair of axially projecting distal arms 55 and 56 and is pivotly secured to the lead trolley 25 by a bolt 57. The inner tube 51 likewise has a pair of distal arms 58 and 59 that are pivotally secured by a bolt 57 to the load supporting trolley 27.

The outer tube 52 includes a pair of diagonally spaced and diametrically opposed apertures 60 located therealong and somewhat near the end thereof opposite the arms 55 and 56. The outer tube 52 has an inner bore 61 that is generally uniform along the length thereof and sized to snugly, but slideably receive the inner tube 51 except between the arms 55 and 56 whereat there is a restrictive throat 63 of reduced size having a central and axially aligned bore 64.

The inner tube 51 has a pair of diametrically opposed slots 67 that are approximately four inches long in the present embodiment and which receive a bolt 62 which also passes through the apertures 60 and is thus held by a nut 65, when the tubes 51 and 52 are fully assembled. The bolt 62 allows the inner tube to telescope when the tubes 51 and 52 are pulled axially apart and compress when the tubes 51 and 52 are urged toward each other axially to the extent of the length of the slots 67. In this way opposite ends 68 and 69 of the slots 67 function as stops limiting comparative telescoping and compressing of the tubes 51 and 52 along the central axis A thereof.

The inner tube 51 has a first tube section 73 and an axially aligned second tube section 74 joined by a connecting spool 75. Apertures 80 located near the end of the first section 73 align with similar apertures 81 on the spool and receive fasteners such as flat head bolts 83 to secure the spool 75 to the first section 73. The second section 74 likewise has apertures 84 located at one end 85 thereof and aligned with apertures 87 of the spool 75 during assembly so as to receive flat head bolts 88 to secure the two together. A second end 90 of the second section 74 also has a series of apertures 91 for a purpose later described.

The dampening or braking assembly 53 is best seen in FIGS. 2 and 4 to 6. The breaking assembly 53 comprises a braking plunger 93, a plunger connecting shaft 94 and a braking or friction adjustment rod 95.

Figure 4:
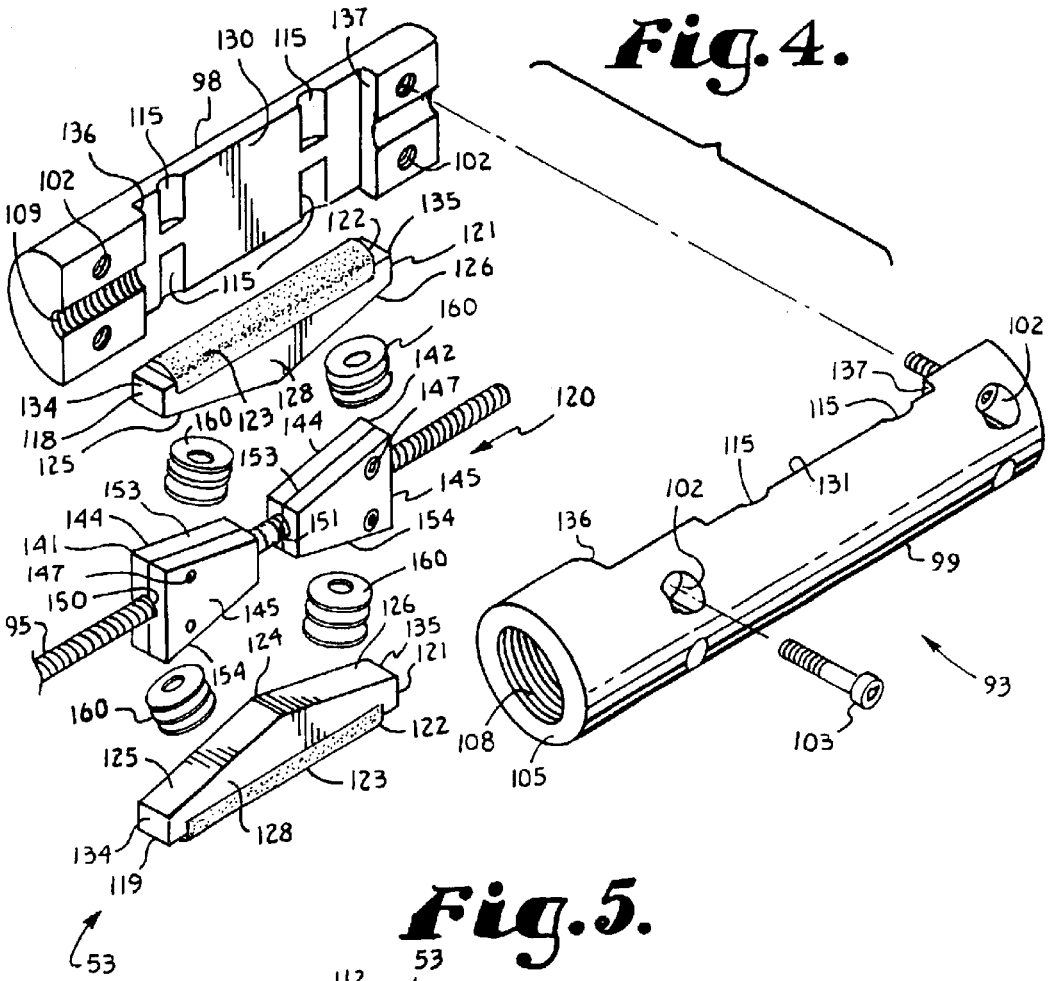
FIG. 4 is an exploded and enlarged perspective view of a portion of the dampening device that forms a reciprocating plunger when fully assembled.
Figure 5:
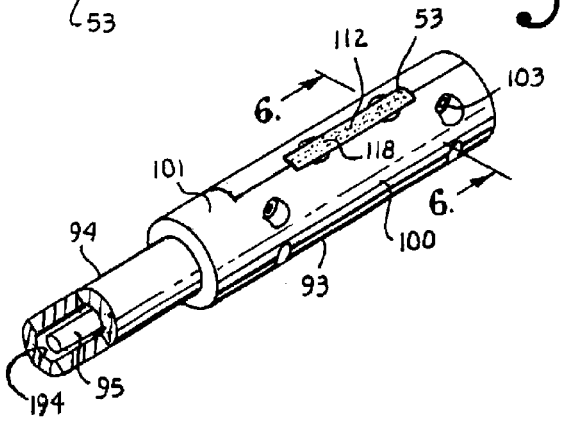
FIG. 5 is an enlarged and fragmentary perspective view of the reciprocating plunger subsequent to assembly thereof.
Figure 6:
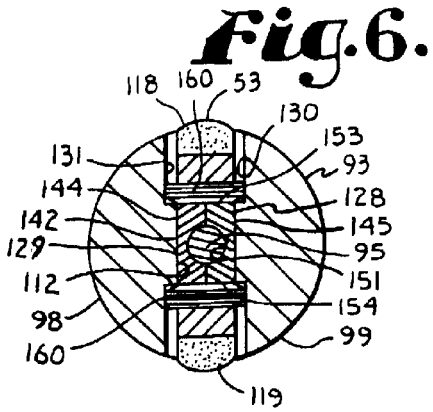
FIG. 6 is an enlarged cross sectional view of the plunger, taken along line 6—6 of FIG. 5.

The braking plunger 93 is shown in the exploded view of FIG. 4. The plunger 93 has a pair of body sections 98 and 99 that join together to form a generally cylindrically shaped body 100 having a generally cylindrical shaped outer surface 101. Located at opposite ends of the body 100 are threaded bolt receiving apertures 102 that receive bolts 103 to secure the sections 98 and 99 together.

Axially aligned and located at one end 105 of the body 100 is a threaded bore 108. A second bore 109 smaller than the bore 108 runs through a remainder of the body 100 along the axis A. The bore 109 is sized and shaped to receive the adjustment rod 95 therethrough and is threaded to rotate in the bore 109 in the manner described below.

An elongate slot 112 extends along a medial portion of the body 100 and extends diagonally from one side to the other side thereof. The slot 112 is generally rectangular in shape. A pair of guide channels or half bores 115 extend from the outer surface part way inward along each side of the slot 112 and from diagonally opposite directions from the surface 101.

Located within the slot 112, when assembled, is a pair of brakes 118 and 119 and a brake pressure or friction adjustment mechanism 120.

Each of the brakes 118 and 119 has a triangular shaped body 121 with a brake shoe 122 mounted with a curved outer braking surface 123. Opposite the surfaces 123 are a pair of spring engaging surfaces 125 and 126 that are angled with respect to each other so as to form a V-shaped under surface and come together at a ridge 124 that is directed away from the surface 123. Each of the brakes 118 and 119 are sized and shaped to fit snugly, but slideably, in the slot 112 with side surfaces 128 and 129 engaging sides 130 and 131 respectively of the slot 112 and ends 134 and 135 of the brakes 118 and 119 respectively engaging ends 136 and 137 of the slot 112.

Positioned between the brakes 118 and 119 are a pair of trapezoidal shaped pressure adjustment wedges 141 and 142. Each of the wedges 141 and 142 are formed from a pair of sections 144 and 145 secured together by screws 147. Located in each of the wedges 141 and 142 is an axially aligned and threaded bore 150 and 151 respectively. The bores 150 and 151 are oppositely threaded and are sized to receive the adjustment rod 95 therein. Each of the wedges 141 and 142 have opposed surfaces 153 and 154 that are sloped at angles that converge centrally and are respectively parallel to but spaced from the brake surfaces 125 and 126. Located between each of the wedge surfaces 153 and 154 and the brake surfaces 125 and 126 is a spring 160. It is foreseen that the springs can be many types of biasing devices.

The adjustment rod 95 is elongate and is sized and shaped to extend from the plunger 93 through the connecting shaft 94 and out thereof. The rod 95 is threaded in the region whereat the rod 95 engages the wedges 141 and 142 with opposed threads 161 and 162, such that when the rod 95 is rotated in one direction, the wedges 141 and 142 move closer together, thus reducing the distance between opposed surfaces and exerting additional pressure on the brakes shoes 122 through the springs 160, and such that when the rod 95 is rotated in an opposite direction, the wedges 141 and 142 move further apart, thus exerting less pressure on the brake shoes 122 through the springs 160. In this manner, the tension, force or pressure applied to the brake shoes 122 can be varied depending on the expected load 26 to be carried by the trolleys 27 and 28, so as to adjust the friction or resistance to movement of the brakes 118 and 119 relative to the tube 51. When the load 26 is of greater weight, greater tension or pressure is necessary to produce greater friction, so that the brakes 118 and 119 can frictionally effectively resist comparative axial movement between the plunger 93 and the tube second section 74. Whereas, when the load 26 is lighter, the pressure can be lessened, so that momentum of the load 26 can overcome the friction due to the brake shoes 122 and so that the brakes 118 and 119 will function to dampen a jarring stop. The same dampening occurs at startup. Further, the pressure applied to the brakes 118 and 119 must not be so great that as to produce more friction than can be overcome by initiating movement of the load 26, as the dampening mechanism 1 must be reset in this way, each time, after coming to a stop. That is, the tubes 51 and 52 must be able to telescope relative to each other along the axis A under the dampening effect of the tow bar 32, as the drive trolley 25 reengages the drive chain dog 15 and the load 26 begins to accelerate.

The rod 95 is sized and shaped such that an end 165 thereof opposite the plunger 93 extends axially outward from the tube 52, either directly or alternative through extensions thereof. In the illustrated embodiment, the rod 95 is two part and has a first part 163 with an axially aligned hex shaped distal end 167. Mounted on the rod end 167 is an extension 166 that has a hex shaped inner aperture 168, extending the length thereof. The aperture 168 receives the rod first part 163 proceeded by a spring 169. Mounted in the aperture 168 opposite the rod 95 is a hex extension 170. The extension 170 is held in place by a pin 171 inserted through a radial bore 172 in the extension 166.

An outer surface 173 of the extension 170 is sized and shaped to receive a hex head tool (not shown) or alternatively a wrench for operably rotating the rod 95 during adjustment, so as to move the wedges 141 and 142, as desired, and thereby change the friction produced by the brake surfaces 123.

A spacer sleeve 174 has a bore 175 sized to be slideably received on the connecting shaft 94 and an outer diameter sized to fit within the tube section 74. A collar 177 is sized to have an inner bore 178 that slideably receives the shaft 94. The collar 177 has a plurality of threaded radial bores 180, that receive screws 181 that seat in the apertures 91 in tube section 74 to secure the collar 177 therein after receiving the plunger 93 and sleeve 174.

A washer 182 and sleeve 183 are mounted on the shaft 94 on a forward neck 186 thereof. The washer 182 is sized to prevent passage through the tube throat 63. A second washer 188 is located, so as to be received over the shaft neck 186 opposite the outer tube throat 63 and is bigger in diameter then the throat 63 so as to secure the shaft 94 therein when a nut 190 is secured on a threaded portion 191 of the shaft neck 186. The shaft 94 has an inner bore 194 which is sized to slidingly receive the rod 95 and an outwardly threaded end 195 that is sized to be threadably received in and mate with the plunger bore 108.

While the illustrated embodiment is sized and shaped such that the plunger 93 has a maximum travel of about four inches within the tube second section 74, as determined by the stops 68 and 69, this distance can be modified to satisfy the needs of a particular conveyor system. For example, the distance can be modified to six inches.

While the invention herein is illustrated in use with a power and free conveyor system, it is foreseen that it can be utilized with virtually any type of conveyor where it is desirable to dampen the effects of quick stops and starts, including overhead conveyors.

It is to be understood that while certain forms of the present invention have been illustrated and described herein, it is not to be limited to the specific forms or arrangement of parts described and shown.

What is claimed and desired to be secured by Letters Patent is as follows:

1. A conveyor system comprising:

a) a first drive trolley adapted to be driven about a track;

b) a second load trolley that is operably driven about said track by said drive trolley;

c) a shock absorbing tow bar joining said drive trolley and said load carrying trolley; said tow bar comprising:

d) a first elongate tube;

e) a second elongate tube reciprocally received relative to said first tube;

f) a plunger secured to said first tube by a shaft and located within said second tube so as to be reciprocal therein;

g) a pair of brake surfaces located on and extending from opposite sides of said plunger so as to frictionally engage said second tube; and h) a brake biasing structure for applying radial outward pressure to said braking surfaces; said brake biasing structure comprising:

i) a pair of wedges each having opposed surfaces that are angled relative to each other;

ii) said brake surfaces being mounted on brake members; each of said brake members having a pair of rear surfaces opposite said brake surfaces;

iii) said brake member surfaces being generally parallel to and facing said wedge surfaces;

iv) biasing springs located between each pair of said brake member rear surfaces and facing wedge surfaces; and v) an adjustment mechanism; each of said wedges being mounted on said adjustment mechanism such that movement of said adjustment mechanism in one direction causes said wedges to move toward one another thereby decreasing spacing between said rear surfaces and respective wedge surfaces and increasing pressure on said braking surfaces and movement in an opposite direction causes said wedges to move away from one another thereby increasing said spacing and decreasing pressure on said braking surfaces.

2. The conveyor system according to claim 1 wherein:

a) each of said wedges has an internal threaded bore with said internal bores being oppositely threaded; and b) said adjustment mechanism is an elongate rod mounted through said wedges threaded bores and having a common thread whereat said rod engages each of said wedges, such that rotation of said rod in one direction causes said wedges to converge and rotation of said rod in a second direction causes said wedges to diverge.

3. The conveyor system according to claim 2 wherein:

a) said rod has a distal end that is adapted to receive a rotating tool.

4. The conveyor system according to claim 1 wherein:

a) said plunger has a medial slot extending diagonally thereacross; said wedges, springs and brake members being slideably mounted within said slot so as to allow said brake surfaces to extend outwardly from opposite sides of said slot.

5. The conveyor system according to claim 4 wherein:

a) said slot has a pair of partial guide channels extending part way radially inward from the exterior of said plunger along each side thereof; said guide channels being sized, shaped and positioned so that each is paired with and facing another guide channel and each pair of guide channels is sized and shaped to receive one of said springs so as to guide such a spring radially and maintain axial position thereof relative to said plunger.

6. A conveyor system comprising:

a) a first drive trolley adapted to be driven about a track;

b) a second load trolley that is operably driven about said track by said drive trolley;

c) a shock absorbing tow bar joining said drive trolley and said load carrying trolley; said tow bar comprising:

d) a first elongate tube;

e) a second elongate tube reciprocally received relative to said first tube;

f) a plunger secured to said first tube by a shaft and located within said second tube so as to be reciprocal therein;

g) a pair of braking surfaces mounted so as to extend radially outward from opposite sides of said plunger and positioned so as to frictionally engage said second tube;

h) a brake biasing structure for applying radial pressure to said braking surfaces;

i) a brake friction adjustment mechanism for operably varying pressure applied to said braking surfaces;

j) an adjustment rod engaging and operably providing for adjustment of said brake friction adjustment mechanism and having an end thereof extending outwardly of said tow bar so as to allow an operator to adjust the pressure applied to said braking surfaces without disassembly of said tow bar;

k) said brake friction adjustment mechanism further comprising:

i) a pair of wedges each having opposed surfaces that are angled relative to each other;

ii) said brake surfaces being mounted on brake members; and brake members each having a pair of rear surfaces opposite said brake surfaces;

iii) said brake member surfaces being aligned generally parallel with respect to said wedge surfaces;

iv) biasing springs located between each of said brake member rear surfaces and said facing wedge surfaces;

v) each of said wedges being mounted on said adjustment rod such that movement of said adjustment rod in one direction causes said wedges to move toward one another thereby increasing pressure on said braking surfaces and movement in an opposite direction causes said wedges to move away from one another thereby decreasing pressure on said braking surfaces.

7. The conveyor system according to claim 6 wherein:

a) each of said wedges has an internal threaded bore; said internal bores being oppositely threaded b) said rod mounted through said wedge threaded bores and having a common thread whereat said rod engages each of said wedges, such that rotation of said rod in one direction causes said wedges to converge and rotation of said rod in a second direction causes said wedges to diverge.

8. The conveyor system according to claim 7 wherein:

a) said plunger has a medial slot extending diagonally thereacross; said wedges, springs and brake members being slideably mounted within said slot so as to allow said brake surfaces to extend outwardly from opposite sides of said slot.

9. The conveyor system according to claim 8 wherein:

a) said slot has a pair of guide bores extending part way radially inward from the exterior along each side thereof; said guide bores being sized, shaped and positioned so that each is facing a paired guide bore; each pair of guide bores being sized and shaped to receive one of said springs so as to radially guide such a spring and axially maintain a position of a respective spring relative to said plunger.

* * * * *